United States Patent [19]

McLaughlin

[11] 4,173,194

[45] Nov. 6, 1979

[54] MARINE CLEAT FOR RECEIVING A THROWN LINE

[76] Inventor: Charles S. McLaughlin, 181 Grove St., Cambridge, Mass. 02138

[21] Appl. No.: 857,118

[22] Filed: Dec. 5, 1977

[51] Int. Cl.[2] ..... B63B 21/04

[52] U.S. Cl. ..... 114/218; 114/230

[58] Field of Search ..... 114/218, 230, 108, 113; 24/128 R, 230.5

[56] References Cited

U.S. PATENT DOCUMENTS

| | | | |
|---|---|---|---|
| 554,228 | 2/1896 | Beckwith | 24/230.5 |
| 3,112,726 | 12/1963 | Faul | 114/218 |
| 3,126,858 | 3/1964 | Rosinski | 114/218 |
| 3,473,505 | 10/1969 | Brown | 114/230 |
| 3,507,243 | 4/1970 | Brown | 114/218 |
| 3,879,812 | 4/1975 | Clinch | 24/230.5 |

*Primary Examiner*—Trygve M. Blix
*Assistant Examiner*—James B. Bechtel

[57] ABSTRACT

A cleat having at least two diverging fingers to receive a tossed mooring line and an aperture disposed below the fingers into which the line drops and in which the line is retained by at least one downward projection extending into the aperture.

14 Claims, 3 Drawing Figures

MARINE CLEAT FOR RECEIVING A THROWN LINE

FIELD OF THE INVENTION

This invention relates to a cleat which automatically receives and engages a mooring line tossed from a boat.

BACKGROUND OF THE INVENTION

Cleats are well known devices for securing vessels to docks. A mooring line from a boat is generally wrapped around such a cleat, thereby fastening it. Tying the mooring line to the cleat, however, is sometimes difficult. In the case of a dock cleat, it is normally necessary for a person to stand on the dock itself in order to tie off the line. In the absence of a person on the dock to do this, a person in the boat must jump off carrying the line. This creates a particular problem where only one person is in the boat. A similar problem is encountered with a mooring buoy when one attempts to secure a boat to a mooring in a lake or harbor. Maneuvering the boat to the buoy and holding it next to it for a long enough time to secure the line to the mooring ring by snagging the ring with a boat hook is somewhat difficult, particularly where only one person is in the boat and he must both maneuver the boat and tie the line at the same time.

A cleat intended for receiving a tossed line is disclosed in Brown U.S. Pat. No. 3,473,505. The structure shown does not have a very large space between its rounded converging upper surfaces for guiding a line thrown toward it into the neck and then into the enlarged lower aperture. The device works best when the line lands perpendicularly to the upper guiding surfaces. Furthermore the line may pull out of the slot as the boat comes closer to the dock and the angle between the line and the dock becomes greater due to the height of the boat.

Rosinski U.S. Pat. No. 3,126,858 shows a combined chock and cleat in which the cleat portion has a pair of horns that linearly converge to a flat bottom having an opening leading to a bottom recess. It was not designed to automatically receive and engage a thrown line.

SUMMARY OF THE INVENTION

I have discovered that the problems of having to leave the boat to secure it to a dock, of having to snag a mooring buoy with a boat hook, and of having a thrown line pull out of a cleat as the boat approaches the dock can be solved by the invention, which comprises a cleat having at least two fingers which are separated at the top and which converge at the bottom into a neck that leads downwardly into an enlarged aperture bounded at the entrance to it from the neck by one or more downwardly protruding projections. When a mooring line, having a weight on its end with larger cross sectional dimensions than the aperture, is tossed so that the line lands between the fingers, the line slips down toward the neck. As the line is pulled toward the boat, the line slips down the neck into the aperture. The line is secured in place when the weight, which cannot pass through the aperture, reaches the cleat. Also the line cannot be pulled out through the neck as the boat approaches since the projection prevents reentry of the line into the neck.

In the preferred embodiment the neck is a slot that is angled downwardly in a direction away from the main portion of the aperture, and there is one projection at the entrance to the aperture. The angle of the slot and the single projection both prevent pulling out of the line.

Another embodiment of this invention has a neck that is a vertical slot which enters an enlarged aperture having a pair of projections, one on each side of the entrance, protruding downwardly into the aperture. This embodiment engages the same type of mooring line in the manner of the previous embodiment. The line here is prevented from leaving the aperture and sliding up the slot by the pair of projections.

Either embodiment can be mounted on a dock or on a mooring buoy or can be formed integrally with the mooring buoy. In both embodiments the aperture can be circular, the circular shape helping to guide the line into the main portion of the aperture in the preferred embodiment.

In general the invention solves the problems stated above with a cleat that is simple, sturdy, easy to manufacture, and easy to use.

PREFERRED EMBODIMENT

I now turn to the drawings and description of the preferred embodiment of the invention.

DRAWINGS

DESCRIPTION

1. Structure

Figure 1:
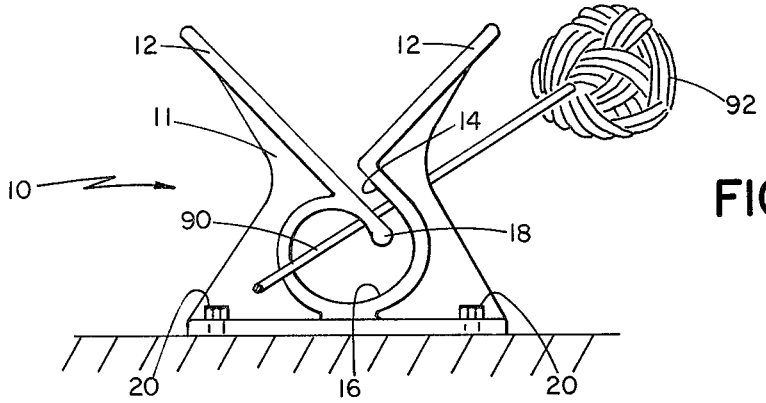
FIG. 1 is a front elevation view of the preferred embodiment of the invention.

FIG. 1 shows cleat 10, which is made of a single piece of molded plastic and includes body 11 and a pair of fingers 12 which extend from body 11 and which upwardly diverge from each other at an angle of approximately 45° from vertical, thereby forming a large opening therebetween. A slot 14 is disposed in cleat 10 and extends from the bottom of the fingers 12 where they converge to a lower aperture 16 disposed near the bottom of cleat 10. A continuous mooring line passageway is therefore created from the large opening between the fingers 12, through the slot 14 and into the aperture 16. Slot 14 is disposed through cleat 10 at a 45° angle from vertical so that while the upper end of the slot 14 adjacent to the fingers 12 is substantially centrally positioned with respect to the cleat 10, the lower end of the slot connects with the right side of aperture 16 near the right side of cleat 10. The left side of the lower end of slot 14 at the entrance to aperture 16, which is the side nearest to the center of aperture 16, is bounded by a projection 18 which extends downwardly into the aperture 16. Slot 14 is downwardly inclined away from the center of aperture 16.

Bolts 20 are placed in holes in the bottom of the cleat 10 for fastening the cleat 10 to a dock.

Figure 2:
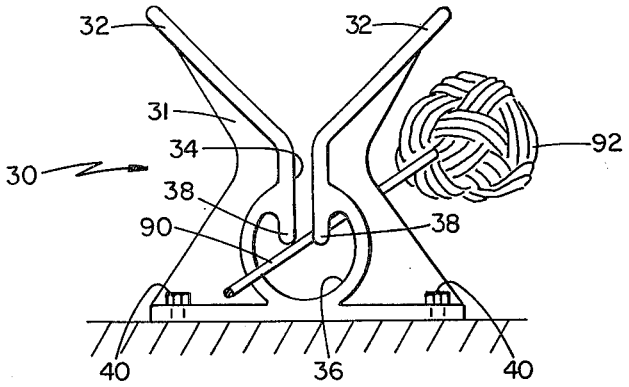
FIG. 2 is a front elevation view of another embodiment of the invention.

In another embodiment, shown in FIG. 2, plastic cleat 30 comprises body 31 and a pair of fingers 32 which upwardly diverge from each other, each at 45° to the vertical, forming a large opening therebetween. A vertical slot 34 which is about four inches in length extends from the bottom of the fingers 32 where they converge to a lower aperture 36 disposed near the bottom of the cleat 30. A continuous mooring line passageway therefore exists from the large opening between the fingers 32, through the vertical slot 34, and into the aperture 36. The slot 34 is bounded on each side at the entrance to aperture 36 by a pair of projections 38 which downwardly extend into aperture 36.

Bolts 40 are placed in holes in the bottom of the cleat 30 for fastening cleat 30 to a dock:

Regarding dimensions, cleats 10 and 30 are both approximately one foot high and one foot wide at their bases, and the distance between fingers 12 and between fingers 32 at their upper tips is also approximately one foot. The width of slots 14 and 34 is about an inch, to accommodate a half-inch or less line.

Figure 3:
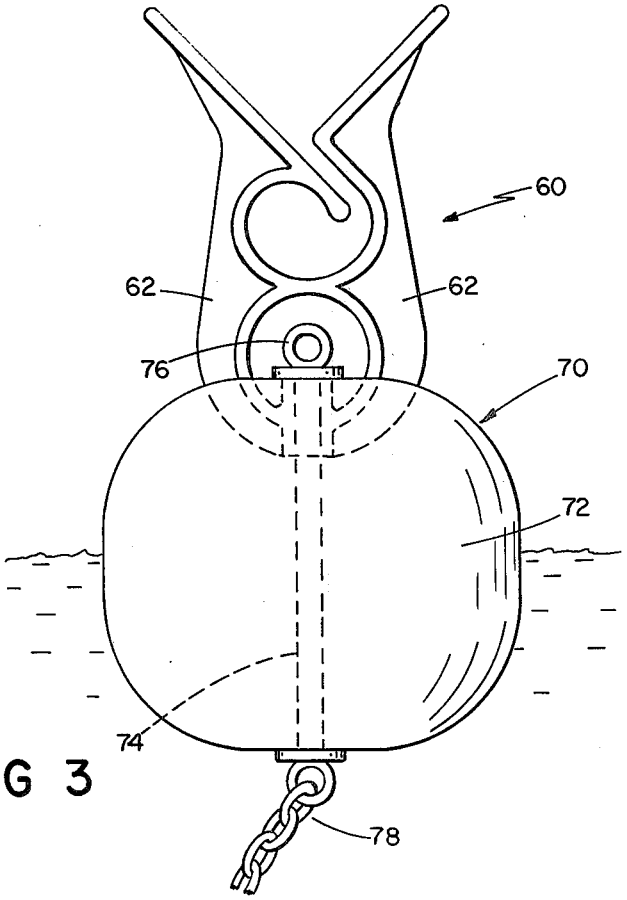
FIG. 3 is a front elevation view of the embodiment of FIG. 1 modified for attachment to a mooring buoy.

FIG. 3 shows cleat 60 attached to mooring buoy 70. The upper portions of cleat 60 are the same as those of cleat 10 (FIG. 1), but the base portions differ. Cleat 60 includes a pair of base legs 62 that are bowed and extend into foamed polystyrene float 72, where they meet and extend upwardly in a tube that engagingly surrounds eye bolt 74, the upper eye of which acts as mooring ring 76 and the lower eye of which is attached to anchor chain 78.

In the embodiments shown in FIGS. 1 through 3 the plastic is made thicker along the edges that contact a mooring line.

The plastic from which the embodiments of FIGS. 1 through 3 are cast can be any suitable plastic that is tough, durable, and light such as a phenol formaldehyde, a polyurethane, or an epoxy.

2. Operation

In operation of the preferred embodiment of FIG. 1, a mooring line 90 (one-half inch in diameter) secured to a boat on one end and having a weight 92, such as the known "monkey's fist" (made from the end of the line and having a lead weight within a pocket of the ball formed by wrapping of the line), on the other end is tossed over the cleat 10 so that weight 92 lands beyond the cleat 10 opposite the boat and the line 90 is received by the large opening between the fingers 12. Line 90 is then drawn back to the boat, and that portion of the line between the fingers 12 of the cleat 10 slips down the slot 14 and into the aperture 16. The line 90 is further pulled until the weight 92 is adjacent to the aperture 16. As the weight 92 has a greater cross sectional diameter than that of the aperture 16, it cannot be pulled through the cleat 10 and the line 90 is thereby secured. Further pulling on the line 90 will therefore move the boat toward the cleat. The line 90 is retained in the cleat 10 even as the boat approaches because the projection 18 and the angle of the slot 14 prevent line 90 from leaving the aperture 16. Once the boat is secured to one or more cleats 10 (e.g., at the stern and bow), the operator can secure the boat further to conventional cleats if desired.

Operation of the embodiment of FIG. 2 is similar to that of the preferred embodiment. Mooring line 90 having weight 92 at its end is tossed over the cleat 30 so that the weight 92 lands on the side of the cleat 30 opposite the boat. The mooring line 90 is received by the large aperture between the fingers 32, and as the line 90 is drawn back to the boat, the portion of the line between the fingers 32 slips down the vertical slot 34 into the aperture 36. Again, the line 90 is secured as the weight is too large to pass through the aperture 36 and is prevented from leaving the aperture 36 by the projections 38 bounding the slot 34.

Operation of the embodiment of FIG. 3 is like that of the embodiment of FIG. 1. Mooring ring 76 is for a permanent mooring after cleat 60 has been used to tie off the line initially.

OTHER EMBODIMENTS

Other embodiments within the invention will occur to those skilled in the art. For example, the aperture may be of any shape including square as long as the weight at the end of the line cannot pass through it. The fingers of the cleat need not be vertical but could be both tilted back away from the boat to help prevent the line from pulling out of the cleat as the boat nears the dock. It is also not necessary for the fingers to incline at the same angle. One finger could, for example, be vertical and the other at an acute angle thereto. It is also possible to substantially eliminate the slot from the cleat, leaving only a short neck, or to make the slot curved or of downwardly narrowing width so as to bind the line at some point. Finally, there could be three or more upwardly diverging fingers extending from the cleat body, with the fingers equally spaced apart from each other in a horizontal plane (e.g., three fingers would be spaced 120° apart), to facilitate receiving a line thrown from many different directions. This embodiment could be well suited for use with the mooring buoy.

The cleat could also be made of single piece of metal.

What is claimed is:

1. A cleat for receiving a thrown line, said cleat comprising:

a body, at least two upwardly diverging fingers extending from said body, said fingers defining an opening for receiving a thrown line, said body containing an aperture disposed below said fingers, means for guiding a line from said opening into said aperture, said means for guiding being formed in said body and extending from said opening near the bottom of said fingers where said fingers converge, downwardly into said aperture, said means for guiding and said fingers cooperating to always direct into said aperture a line thrown between said fingers, and projection means for preventing a line extending through said aperture from being pulled up into said means for guiding, said projection means being disposed adjacent to the interface of said means for guiding and said aperture and extending downwardly into said aperture.

2. The cleat of claim 1 wherein said means for guiding comprises a slot.

3. The cleat of claim 2 wherein said slot is inclined at an acute angle to the vertical.

4. The cleat of claim 3 wherein said projection means comprises a downwardly protruding projection disposed on the side of said slot nearest the center of said aperture and said slot is inclined away from said center of said aperture.

5. The cleat of claim 1 wherein said aperture is substantially circular.

6. The cleat of claim 2 wherein said slot extends vertically.

7. The cleat of claim 6 wherein said projection means comprises a pair of projections each disposed on each side of said slot.

8. The cleat of claim 1 further comprising means for mounting said cleat to a dock.

9. The cleat of claim 1 further comprising means for mounting said cleat to a mooring buoy.

10. The cleat of claim 9 wherein said means for mounting includes a pair of legs adapted to extend downwardly from said cleat body into the float of a mooring buoy.

11. The cleat of claim 1 wherein said cleat body and fingers are formed from a single piece of plastic.

12. The cleat of claim 1 wherein said cleat body and fingers are formed from a single piece of metal.

13. The cleat of claim 1 wherein said fingers have flat upper guiding surfaces.

14. The cleat of claim 3 wherein said slot is inclined at 45° to the vertical.

* * * * *